US011621017B2

(12) United States Patent
Ebenezer

(10) Patent No.: US 11,621,017 B2
(45) Date of Patent: Apr. 4, 2023

(54) EVENT DETECTION FOR PLAYBACK MANAGEMENT IN AN AUDIO DEVICE

(71) Applicant: Cirrus Logic International Semiconductor Ltd., Edinburgh (GB)

(72) Inventor: Samuel Pon Varma Ebenezer, Tempe, AZ (US)

(73) Assignee: Cirrus Logic, Inc., Austin, TX (US)

( * ) Notice: Subject to any disclaimer, the term of this patent is extended or adjusted under 35 U.S.C. 154(b) by 230 days.

(21) Appl. No.: 15/229,429

(22) Filed: Aug. 5, 2016

(65) Prior Publication Data

US 2017/0040029 A1 Feb. 9, 2017

Related U.S. Application Data

(60) Provisional application No. 62/351,499, filed on Jun. 17, 2016, provisional application No. 62/237,868, (Continued)

(51) Int. Cl.
*G10L 25/51* (2013.01)
*G10L 25/18* (2013.01)
(Continued)

(52) U.S. Cl.
CPC ..... *G10L 25/51* (2013.01); *G10L 25/18* (2013.01); *H04R 1/1083* (2013.01); *H04R 3/002* (2013.01);
(Continued)

(58) Field of Classification Search
CPC ..... G10L 25/51; G10L 25/18; G10L 2021/02166; G10L 25/84; G10L 25/78;
(Continued)

(56) References Cited

U.S. PATENT DOCUMENTS 4,306,115 A * 12/1981 Humphrey ..... H03G 3/32 381/107
7,903,825 B1 3/2011 Melanson
(Continued)

FOREIGN PATENT DOCUMENTS

JP 2002516535 A 6/2002
JP 2004013084 A 1/2004
(Continued)

OTHER PUBLICATIONS

Ozgur Izmirli, 2000, Using a Spectral Flatness Based Feature for Audio Segmentation and Retrieval Abstract; pp. All (Year: 2000).*
(Continued)

*Primary Examiner* — Richa Mishra
(74) *Attorney, Agent, or Firm* — Jackson Walker L.L.P.

(57) ABSTRACT

In accordance with embodiments of the present disclosure, a method for processing audio information in an audio device may include reproducing audio information by generating an audio output signal for communication to at least one transducer of the audio device, receiving at least one input signal indicative of ambient sound external to the audio device, detecting from the at least one input signal a near-field sound in the ambient sound, and modifying a characteristic of the audio information reproduced to the at least one transducer in response to detection of the near-field sound.

73 Claims, 9 Drawing Sheets

Related U.S. Application Data filed on Oct. 6, 2015, provisional application No. 62/202,303, filed on Aug. 7, 2015.

(51) Int. Cl.

| | |
|---|---|
| ***H04R 1/10*** | (2006.01) |
| ***H04R 3/00*** | (2006.01) |
| ***H04R 7/00*** | (2006.01) |
| ***G10L 25/84*** | (2013.01) |
| ***G10L 21/0216*** | (2013.01) |
| ***H04S 7/00*** | (2006.01) |
| *G10L 25/78* | (2013.01) |
| *G10L 25/81* | (2013.01) |

(52) U.S. Cl.

CPC ..... *H04S 7/00* (2013.01); *G10L 25/78* (2013.01); *G10L 25/81* (2013.01); *G10L 25/84* (2013.01); *G10L 2021/02166* (2013.01); *G10L 2025/783* (2013.01); *H04R 3/005* (2013.01); *H04R 2410/05* (2013.01)

(58) Field of Classification Search

CPC ..... H04S 7/00; H04R 3/002; H04R 1/1083; H04R 3/005; H04R 2410/05

See application file for complete search history.

(56) References Cited

U.S. PATENT DOCUMENTS

| | | | | |
|---|---|---|---|---|
| 8,126,706 | B2 | 2/2012 | Ebenezer | |
| 8,565,446 | B1 * | 10/2013 | Ebenezer | H04R 3/005 381/94.1 |
| 8,712,069 | B1 * | 4/2014 | Murgia | H04R 3/005 381/71.1 |
| 8,804,974 | B1 | 8/2014 | Melanson | |
| 2008/0091421 | A1 | 4/2008 | Gustavsson | |
| 2008/0240458 | A1 | 10/2008 | Goldstein et al. | |
| 2010/0278352 | A1 * | 11/2010 | Petit | H04R 3/005 381/71.1 |
| 2012/0046906 | A1 * | 2/2012 | Alameh | H03K 17/945 702/150 |
| 2013/0282373 | A1 * | 10/2013 | Visser | G10L 21/0316 704/233 |
| 2014/0270200 | A1 * | 9/2014 | Usher | G10L 25/78 381/57 |
| 2014/0286497 | A1 * | 9/2014 | Thyssen | H04R 3/005 381/66 |
| 2015/0171813 | A1 * | 6/2015 | Ganatra | H03G 3/24 381/57 |
| 2015/0289070 | A1 * | 10/2015 | Armstrong-Muntner | G01S 15/003 381/56 |
| 2017/0280239 | A1 * | 9/2017 | Sekiya | G10L 15/20 |

FOREIGN PATENT DOCUMENTS

| | | | | |
|---|---|---|---|---|
| JP | 2004187283 | A | 7/2004 | |
| JP | 2004336251 | A | 11/2004 | |
| JP | 2011-097268 | A | 5/2011 | |
| WO | 2006011310 | A1 | 2/2006 | |
| WO | 2008083315 | A2 | 7/2008 | |
| WO | WO-2008083315 | A2 * | 7/2008 | H04R 25/453 |
| WO | 2013166439 | A1 | 11/2013 | |

OTHER PUBLICATIONS

International Search Report and Written Opinion of the International Searching Authority, International Application No. PCT/US2016/045834, dated Mar. 13, 2017.

Communication pursuant to Article 94(3) EPC, European Patent Office, Application No. 16763354.4, dated Nov. 22, 2019.

First Examination Opinion Notice, State Intellectual Property Office of the People's Republic of China, Application No. 201680058340.7, dated Dec. 19, 2019.

Second Examination Opinion Notice, State Intellectual Property Office of the People's Republic of China, Application No. 201680058340.7, dated Jul. 13, 2020.

Office Action, Japanese Patent Application No. 2018-526614, dated Oct. 1, 2020.

* cited by examiner

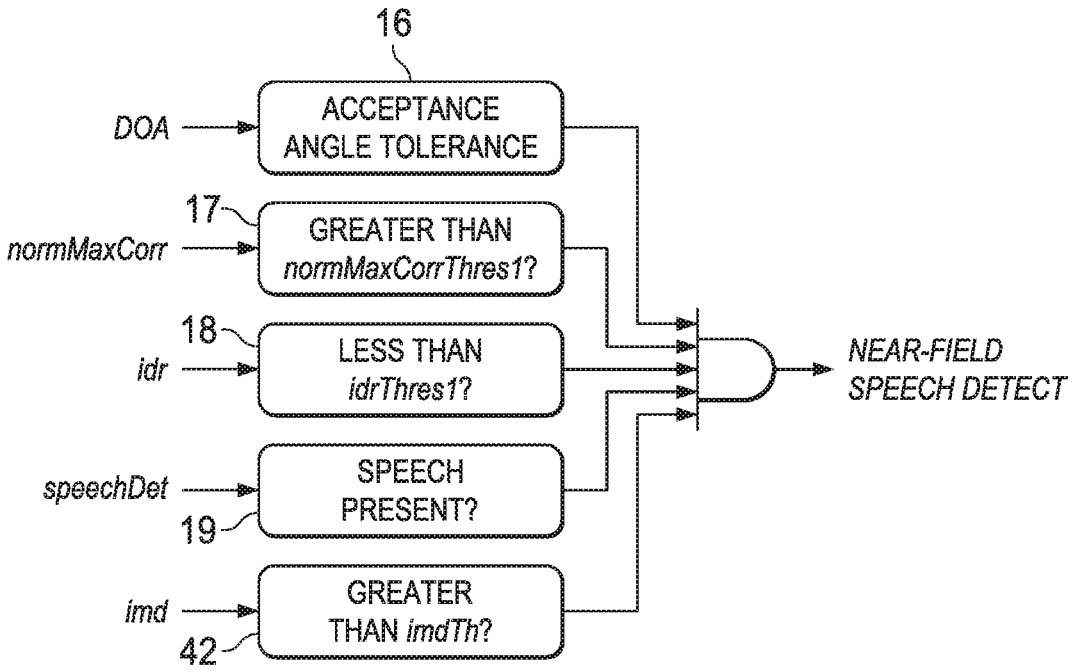
FIG. 5
FIG. 10
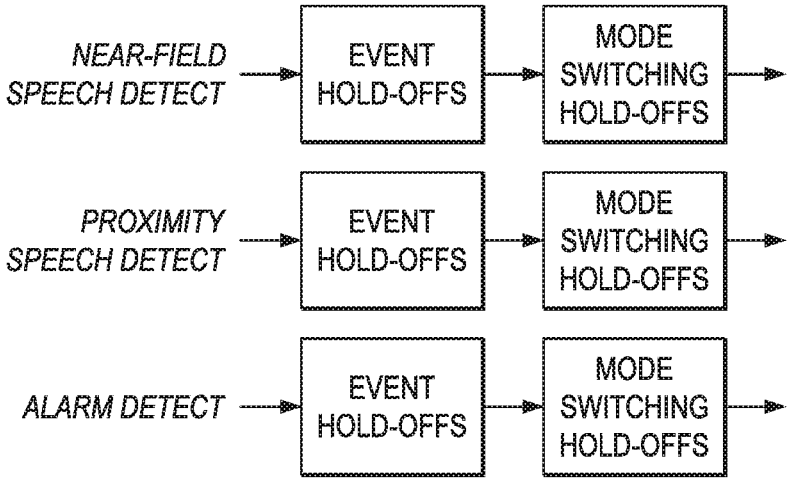

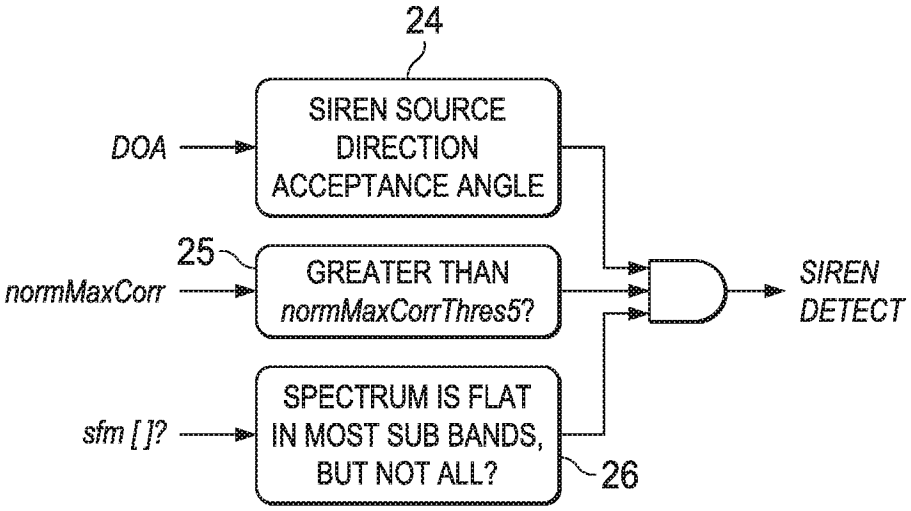
FIG. 8
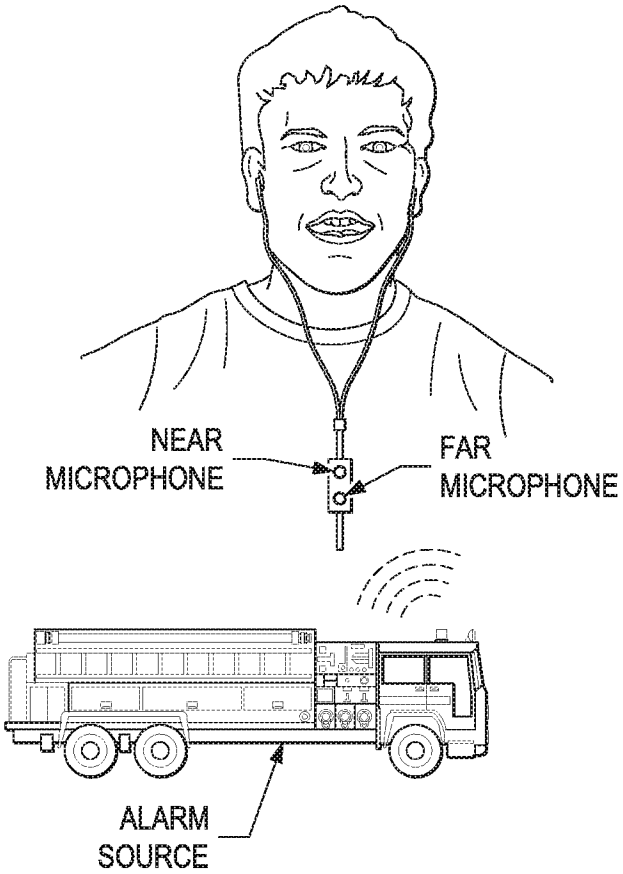

EVENT DETECTION FOR PLAYBACK MANAGEMENT IN AN AUDIO DEVICE

RELATED APPLICATIONS

The present disclosure claims priority to U.S. Provisional Patent Application Ser. No. 62/202,303, filed Aug. 7, 2015, U.S. Provisional Patent Application Ser. No. 62/237,868, filed Oct. 6, 2015, and U.S. Provisional Patent Application Ser. No. 62/351,499, filed Jun. 17, 2016, each of which is incorporated by reference herein in its entirety.

FIELD

The field of representative embodiments of this disclosure relates to methods, apparatuses, or implementations concerning or relating to playback management in an audio device. Applications include detection of certain ambient events, but are not limited to, those concerning the detection of near-field sound, proximity sound and tonal alarm detection using spatial processing based on signals received from multiple microphones.

BACKGROUND

Personal audio devices have become prevalent and they are used in diverse ambient environments. The headphones used in these audio devices have become advanced such that the occlusion caused by either passive or active methods prevents a user from keeping track of an ambient sound field external to the audio device. Even though the increased isolation and uninterrupted listening is preferable in most cases, sometimes for safety or enhanced user experience, it is imperative that some specific ambient events are heard by the user and an appropriate action is taken in response to that event. For example, if the user is listening to music through his headset and interrupted by someone attempting to start a conversation with him or her, it may be difficult to maintain the conversation unless the user pauses the playback signal or reduces the volume of the playback signal. For example, U.S. Pat. No. 7,903,825 proposes an audio device in which the playback signal is modified depending on the ambient acoustic field. As another example, U.S. Pat. No. 8,804,974 teaches ambient event detection in a personal audio device which can then be used to implement an event-based modification of the playback content. The above-mentioned references also teach the use of microphones to detect various acoustic events. As a further example, U.S. application Ser. No. 14/324,286, filed on Jul. 7, 2014, teaches using a speech detector as an event detector to adjust the playback signal during a conversation. As an additional example, U.S. Pat. No. 8,565,446 teaches the use of a direction of arrival (DOA) estimate and an interference to desired (near-field) speech signal ratio estimate from a set of plural microphones to detect desired speech in the presence of non-stationary background noise to control a speech enhancement algorithm in a noise reduction echo cancellation (NREC) system. Similarly, U.S. application Ser. No. 13/199,593 teaches that a maximum of the normalized cross-correlation statistic that is derived through a cross-correlation analysis of plural microphones may be an effective discriminator to detect near-field speech. A spectral flatness measure-based music detector for a NREC system is proposed in U.S. Pat. No. 8,126,706 to differentiate the presence of background noise from the background music. U.S. Pat. Nos. 7,903,825; 8,804,974; U.S. application Ser. No. 14/324,286; U.S. Pat. No. 8,565,446; U.S. application Ser. No. 13/199,593; and U.S. Pat. No. 8,126,706 are incorporated by reference herein.

SUMMARY

In accordance with the teachings of the present disclosure, one or more disadvantages and problems associated with existing approaches to event detection for playback management in a personal audio device may be reduced or eliminated.

In accordance with embodiments of the present disclosure, a method for processing audio information in an audio device may include reproducing audio information by generating an audio output signal for communication to at least one transducer of the audio device, receiving at least one input signal indicative of ambient sound external to the audio device, detecting from the at least one input signal a near-field sound in the ambient sound, and modifying a characteristic of the audio information reproduced to the at least one transducer in response to detection of the near-field sound.

In accordance with these and other embodiments of the present disclosure, an integrated circuit for implementing at least a portion of an audio device may include an audio output configured to reproduce audio information by generating an audio output signal for communication to at least one transducer of the audio device, a microphone input configured to receive an input signal indicative of ambient sound external to the audio device, and a processor configured to detect from the input signal a near-field sound in the ambient sound and modify a characteristic of the audio information in response to detection of the near-field sound.

In accordance with these and other embodiments of the present disclosure, a method for processing audio information in an audio device may include reproducing audio information by generating an audio output signal for communication to at least one transducer of the audio device, receiving at least one input signal indicative of ambient sound external to the audio device, detecting from the at least one input signal an audio event, and modifying a characteristic of the audio information reproduced to the at least one transducer in response to detection of the audio event being persistent for at least a predetermined time.

In accordance with these and other embodiments of the present disclosure, an integrated circuit for implementing at least a portion of an audio device, may include an audio output configured to reproduce audio information by generating an audio output signal for communication to at least one transducer of the audio device, a microphone input configured to receive an input signal indicative of ambient sound external to the audio device, and a processor configured to detect from the input signal an audio event and modify a characteristic of the audio information reproduced to the at least one transducer in response to detection of the audio event being persistent for at least a predetermined time.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the example, present embodiments and certain advantages thereof may be acquired by referring to the following description taken in conjunction with the accompanying drawings, in which like reference numbers indicate like features, and wherein:

FIG. 5 illustrates example fusion logic for detecting near-field sound, in accordance with embodiments of the present disclosure;

FIG. 8 illustrates example fusion logic for detecting a tonal alarm event, in accordance with embodiments of the present disclosure;

FIG. 10 illustrates different audio event detectors having hold-off and hang-over logic, in accordance with embodiments of the present disclosure.

DETAILED DESCRIPTION

Figure 1:
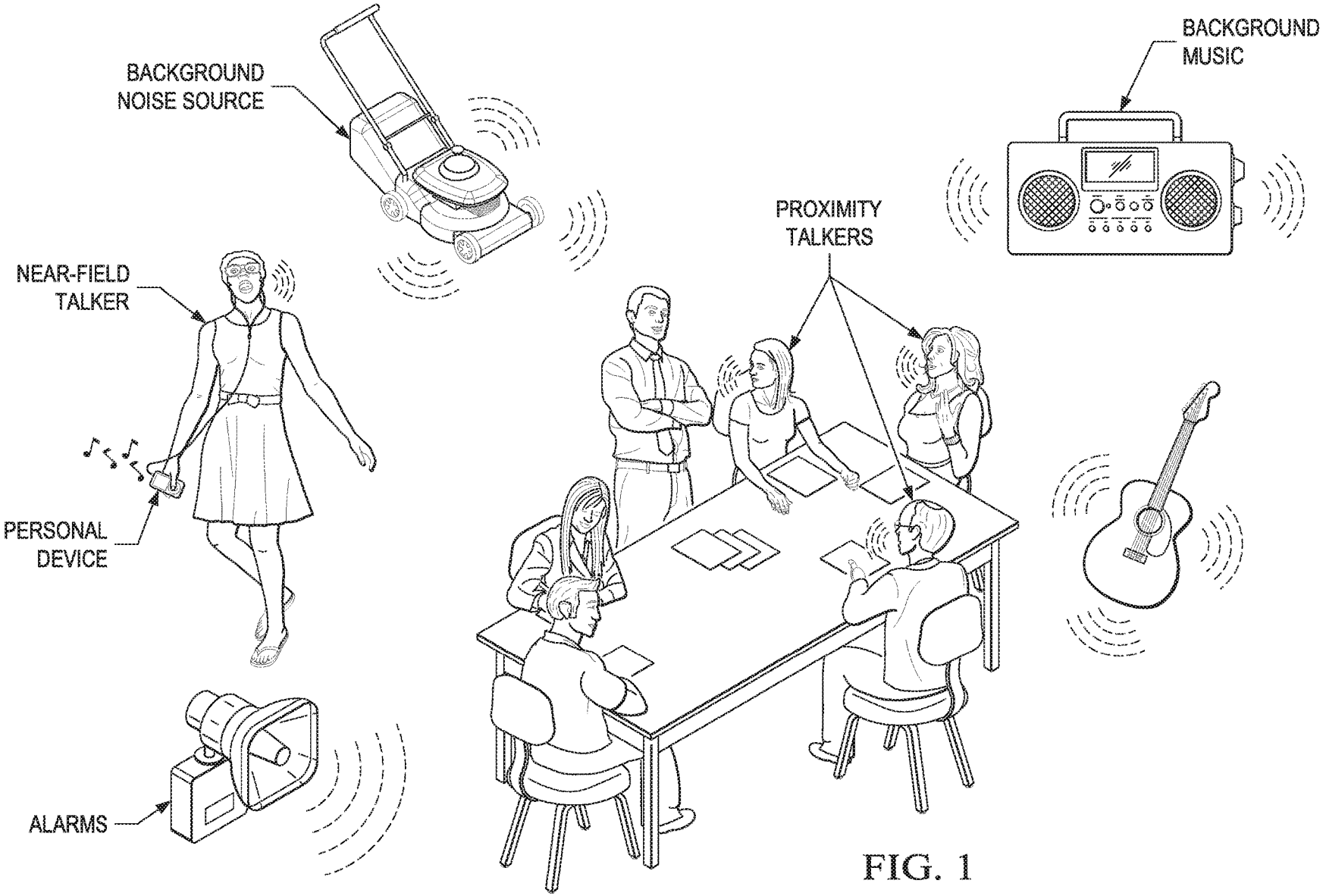
FIG. 1 illustrates an example of a use case scenario wherein such detectors may be used in conjunction with a playback management system to enhance a user experience, in accordance with embodiments of the present disclosure.

In accordance with embodiments of this disclosure, systems and methods may use at least three different audio event detectors that may be used in an automatic playback management framework. Such audio event detectors for an audio device may include a near-field detector that may detect when sounds in the near-field of the audio device is detected, such as a user of the audio device (e.g., a user that is wearing or otherwise using the audio device) speaks, a proximity detector that may detect when sounds in proximity to the audio device is detected, such as when another person in proximity to the user of the audio device speaks, and a tonal alarm detector that detects acoustic alarms that may have been originated in the vicinity of the audio device are proposed. FIG. 1 illustrates an example of a use case scenario wherein such detectors may be used in conjunction with a playback management system to enhance a user experience, in accordance with embodiments of the present disclosure.

Figure 2:
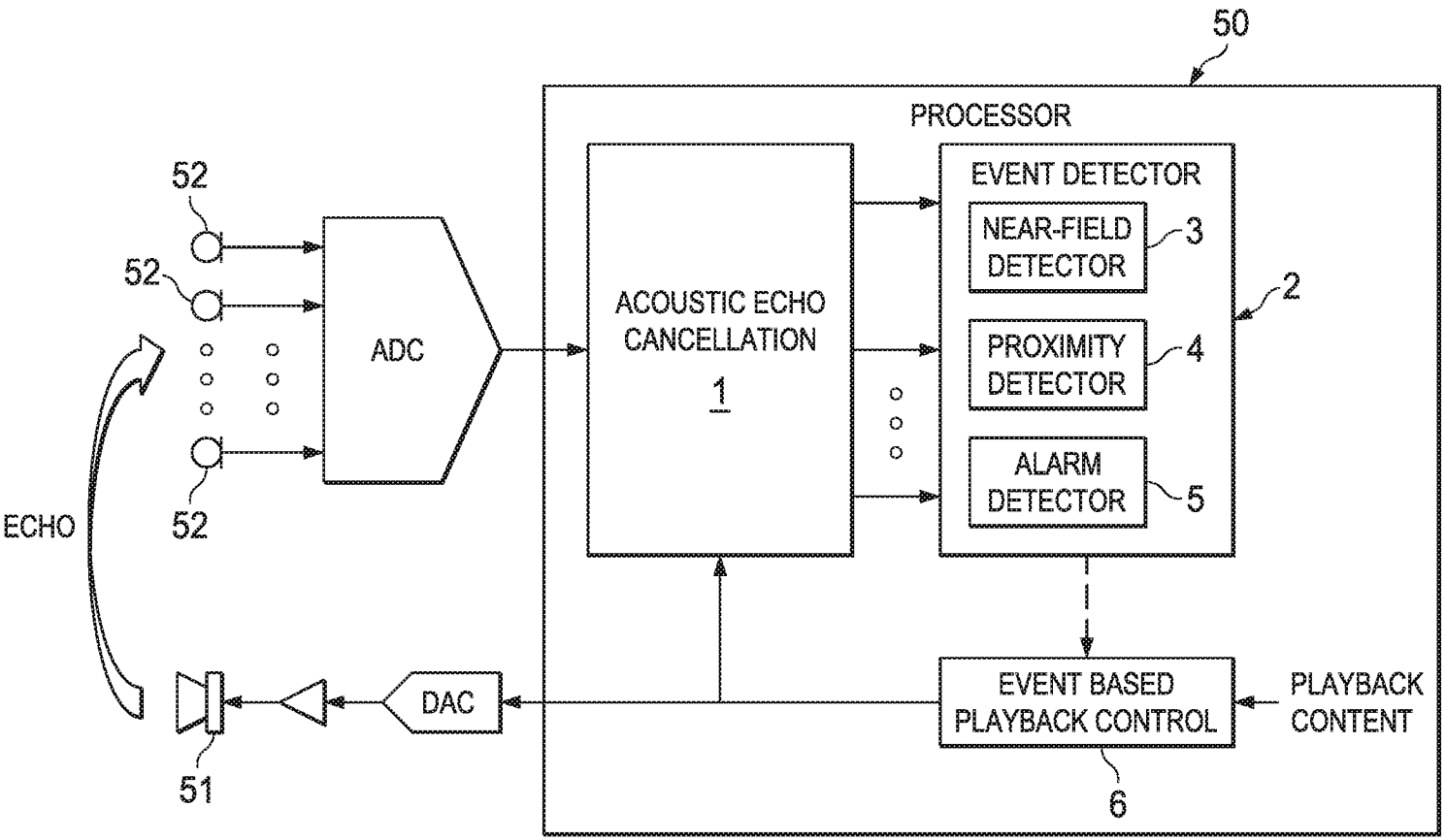
FIG. 2 illustrates an example playback management system that modifies a playback signal based on a decision from an event detector, in accordance with embodiments of the present disclosure.

FIG. 2 illustrates an example playback management system that modifies a playback signal based on a decision from an event detector 2, in accordance with embodiments of the present disclosure. Signal processing functionality in a processor 50 may comprise an acoustic echo canceller 1 that may cancel an acoustic echo that is received at microphones 52 due to an echo coupling between an output audio transducer 51 (e.g., loudspeaker) and microphones 52. The echo reduced signal may be communicated to event detector 2 which may detect one or more various ambient events, including without limitation a near-field event (e.g., including but not limited to speech from a user of an audio device) detected by near-field detector 3, a proximity event (e.g., including but not limited to speech or other ambient sound other than near-field sound) detected by proximity detector 4, and/or a tonal alarm event detected by alarm detector 5. If an audio event is detected, an event-based playback control 6 may modify a characteristic of audio information (shown as "playback content" in FIG. 2) reproduced to output audio transducer 51. Audio information may include any information that may be reproduced at output audio transducer 51, including without limitation, downlink speech associated with a telephonic conversation received via a communication network (e.g., a cellular network) and/or internal audio from an internal audio source (e.g., music file, video file, etc.).

Figure 3:
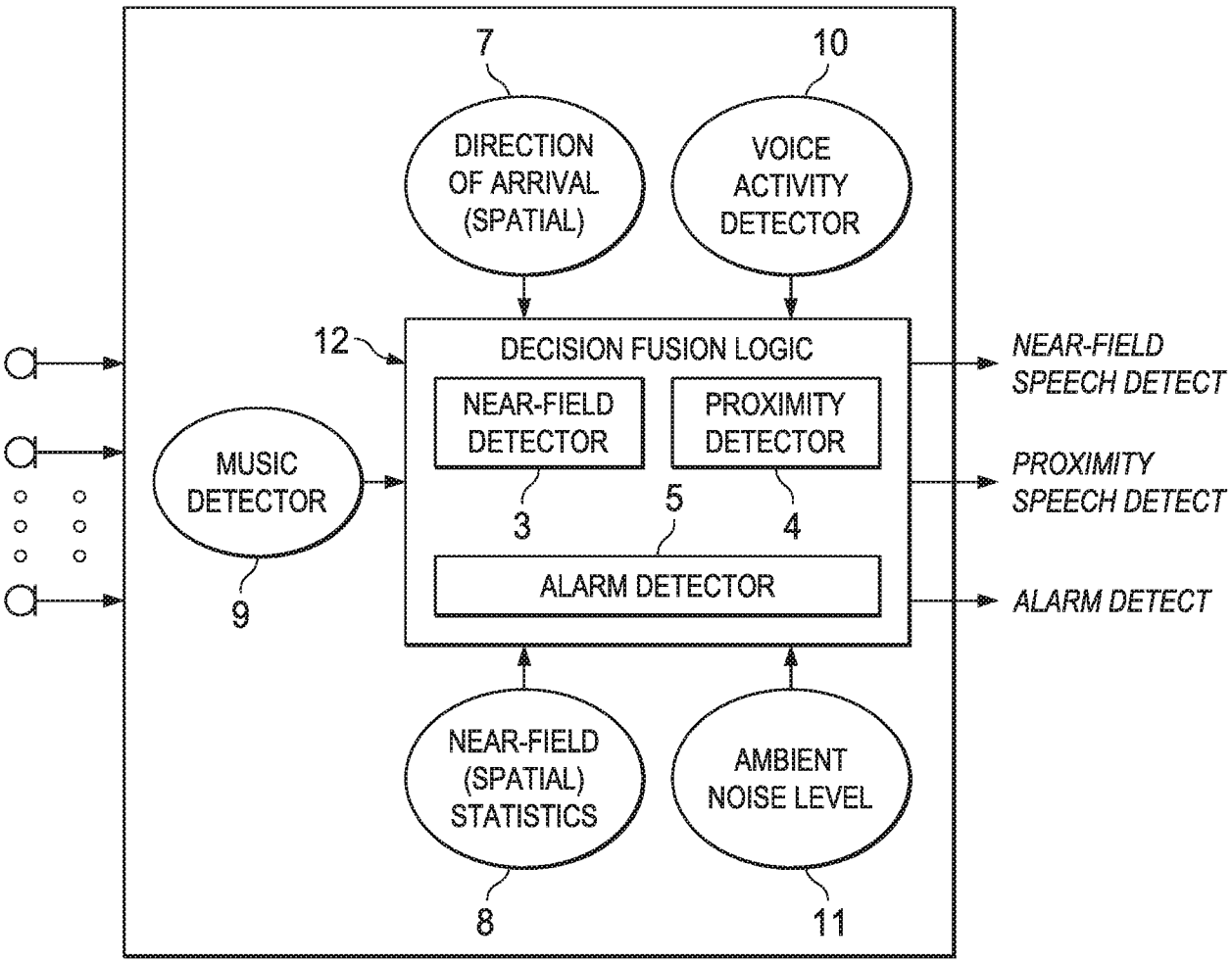
FIG. 3 illustrates an example event detector, in accordance with embodiments of the present disclosure.

FIG. 3 illustrates an example event detector, in accordance with embodiments of the present disclosure. As shown in FIG. 3, the example event detector may comprise a voice activity detector 10, a music detector 9, a direction of arrival estimator 7, a near-field spatial information extractor 8, a background noise level estimator 11, and decision fusion logic 12 that uses information from voice activity detector 10, music detector 9, direction of arrival estimator 7, near-field spatial information extractor 8, and background noise level estimator 11 to detect audio events, including without limitation, near-field sound, proximity sound other than near-field sound, and a tonal alarm.

Near-field detector 3 may detect near-field sounds including speech. When such near-field sound is detected, it may be desirable to modify audio information reproduced to output audio transducer 51, as detection of near-field sound may indicate that a user is participating in a conversation. Such near-field detection may need to be able to detect near-field sound in acoustically noisy conditions and be resilient to false detection of near-field sounds in very diverse background noise conditions (e.g., background noise in a restaurant, acoustical noise when driving a car, etc.). As described in greater detail below, near-field detection may require spatial sound processing using a plurality of microphones 52. In some embodiments, such near-field sound detection may be implemented in a manner identical or similar to that described in U.S. Pat. No. 8,565,446 and/or U.S. application Ser. No. 13/199,593.

Proximity detector 4 may detect ambient sounds (e.g., speech from a person in proximity to a user, background music, etc.) other than near-field sounds. As described in greater detail below, because it may be difficult to differentiate proximity sounds from non-stationary background noise and background music, proximity detector may utilize a music detector and noise level estimation to disable proximity detection of proximity detector 4 in order to avoid poor user experience due to false detection of proximity sounds. In some embodiments, such proximity sound detection may be implemented in a manner identical or similar to that described in U.S. Pat. Nos. 8,126,706, 8,565,446, and/or U.S. application Ser. No. 13/199,593.

Tonal alarm detector 5 may detect tonal alarms (e.g., sirens) proximate to an audio device. To provide maximum user experience, it may be desirable that tonal alarm detector 5 ignores certain alarms (e.g., feeble or low-volume alarms). As described in greater detail below, tonal alarm detection may require spatial sound processing using a plurality of microphones 52. In some embodiments, such tonal alarm detection may be implemented in a manner identical or similar to that described in U.S. Pat. No. 8,126,706 and/or U.S. application Ser. No. 13/199,593.

Figure 4:
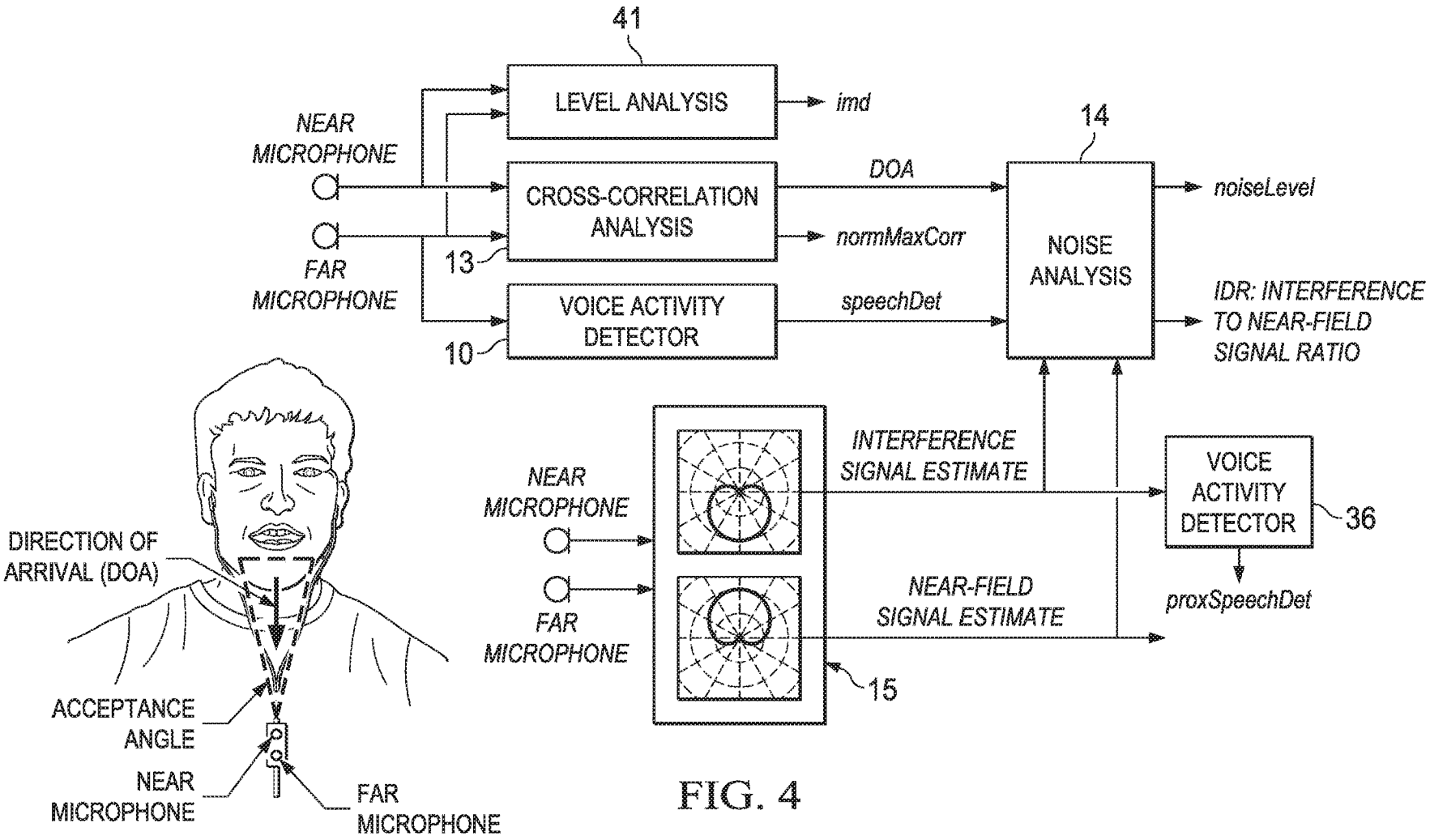
FIG. 4 illustrates functional blocks of a system for deriving near-field spatial statistics that may be used to detect audio events, in accordance with embodiments of the present disclosure.

FIG. 4 illustrates functional blocks of a system for deriving near-field spatial statistics that may be used to detect audio events, in accordance with embodiments of the present disclosure. The level analysis 41 may be performed on microphones 52 by estimating the inter-microphone level difference (imd) between the near and far microphone (e.g., as described in U.S. application Ser. No. 13/199,593). Cross-correlation analysis 13 may be performed on signals received by microphones 52 to obtain the direction of arrival information DOA of ambient sound that impinges on microphones 52 (e.g., as described in U.S. Pat. No. 8,565,446). In cross-correlation analysis 13, a maximum normalized correlation value normMaxCorr may also be obtained (e.g., as described in U.S. application Ser. No. 13/199,593). Voice activity detector 10 may detect presence of speech and generate a signal speechDet indicative of presence or absence of speech in the ambient sound (e.g., as described in the probabilistic based speech presence/absence based approach of U.S. Pat. No. 7,492,889). Beamformers 15 may, based on signals from microphones 52, generate a near-field signal estimate and an interference signal estimate which may be used by a noise analysis 14 to determine a level of noise noiseLevel in the ambient sound and an interference to near-field signal ratio idr. U.S. Pat. No. 8,565,446 describes an example approach for estimating interference to near-field signal ratio idr using a pair of beamformers 15. A voice activity detector 36 may use the interference estimate to detect (proxSpeechDet) any speech signal that does not originate from the desired signal direction. Noise analysis 14 may be performed based on the direction of arrival estimate DOA by updating interference signal energy whenever the direction of arrival estimate DOA of the ambient sound is outside the acceptance angle of the near-field sound. The direction of arrival of the near-field sounds may be known a priori for a given microphone array configuration in the industrial design of a personal audio device.

The various statistics generated by the system of FIG. 4 may then be used to detect the presence of near-field sound. FIG. 5 illustrates example fusion logic for detecting near-field sound, in accordance with embodiments of the present disclosure. As shown in FIG. 5, near-field speech may be detected when all the following criteria are satisfied:

- Direction of arrival estimate DOA of ambient sound is within an acceptance angle of near-field sound (block 16);
- Maximum normalized cross-correlation statistic normMaxCorr is greater than a threshold normMaxCorrThres1 (block 17);
- Interference to near-field desired signal ratio idr is smaller than a threshold idrThres1 (block 18);
- Voice activity is detected as indicated by signal speechDet (block 19); and
- Inter-microphone level difference statistic imd is greater than a threshold imdTh (block 42).

In some embodiments, thresholds idrThres and imdTh may be dynamically adjusted based on a background noise level estimate.

Figure 6:
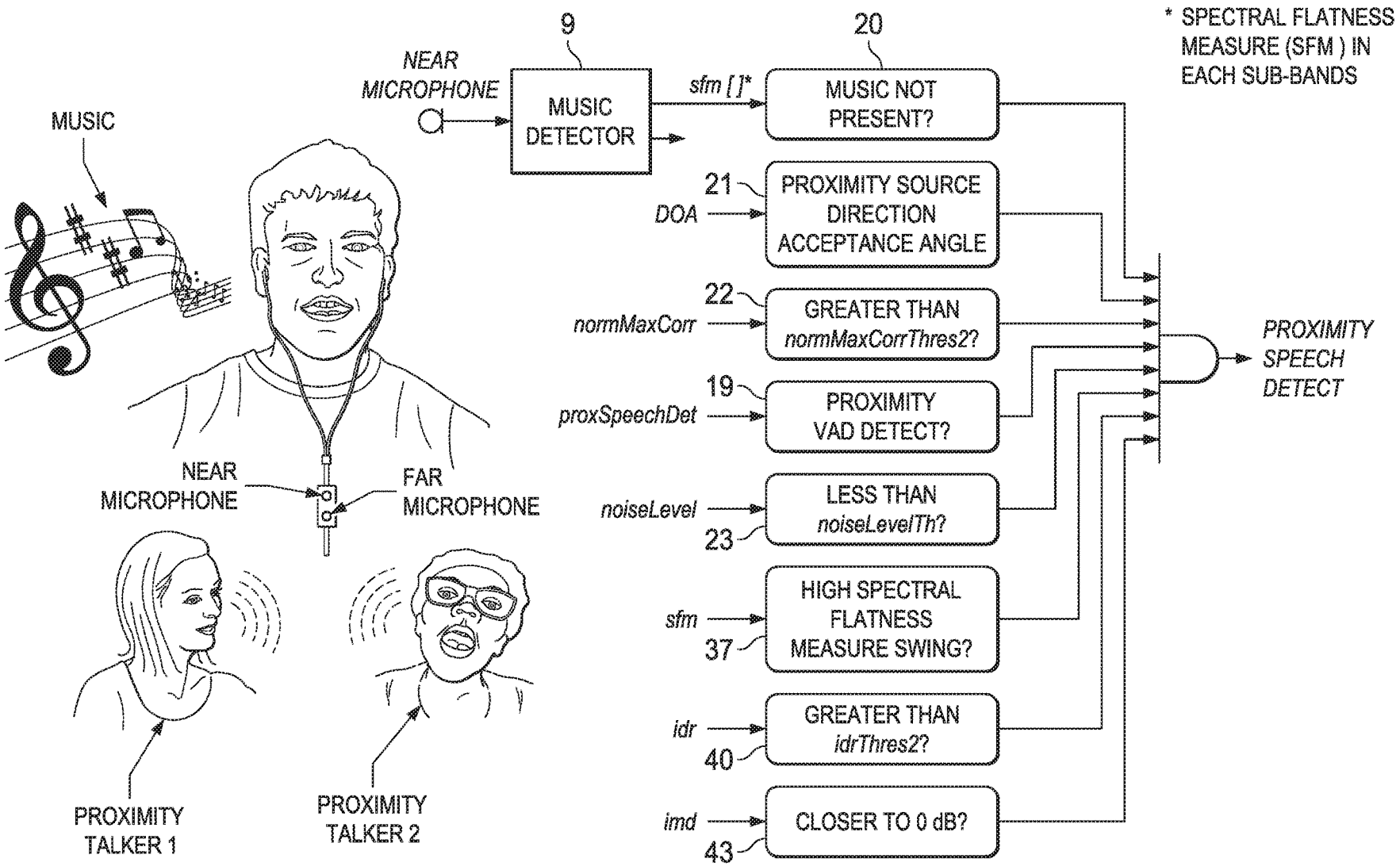
FIG. 6 illustrates example fusion logic for detecting proximity sound, in accordance with embodiments of the present disclosure.

Proximity detection of proximity detector 4 may be different than near-field sound detection of near-field detector 3 because the signal characteristics of proximity speech may be very similar to ambient signals such as music and noise. Accordingly, proximity detector 4 must avoid false detection of proximity speech in order to achieve acceptable user experience. Accordingly, a music detector 9 may be used to disable proximity detection whenever there is music in the background. Similarly, proximity detector 4 may be disabled whenever background noise level is above certain threshold. The threshold value for background noise may be determined a priori such that a likelihood of false detection below the threshold level is very low. FIG. 6 illustrates example fusion logic for detecting proximity sound (e.g. speech), in accordance with embodiments of the present disclosure. Moreover, there may exist many environment noise sources that generate acoustic stimuli that are transient in nature. These noise types can be falsely detected as speech signal by the speech detector. To reduce the likelihood of false detection, a spectral flatness measure (SFM) statistic from the music detector 9 may be used to distinguish speech from transient noises. For example, the SFM may be tracked over a period of time and the difference between the maximum and the minimum SFM value over the same duration, defined as sfmSwing may be calculated. The value of sfmSwing may generally be small for transient noise signals as the spectral content of these signals are wideband in nature and they tend to be stationary for a short interval of time (300-500 ms). The value of sfmSwing may be higher for speech signals because the spectral content of speech signal may vary faster than transient signals. As shown in FIG. 6, proximity sound (e.g., speech) may be detected when all the following criteria are satisfied:

- Music is not detected in the background (block 20);
- Direction of arrival of estimate DOA is within an acceptance angle of proximity sound (block 21);
- Maximum normalized cross-correlation statistic normMaxCorr is greater than a threshold, normMaxCorrThres2 (block 22);
- The background noise level noiseLevel is below a threshold noiseLevelTh (block 23); and
- Proximity voice activity is detected, as indicated by signal proxSpeechDet (block 19);
- SFM variation statistic sfmSwing is greater than a threshold sfmSwingTh (block 37);
- Interference to near-field desired signal ratio idr is greater than a threshold idrThres2 (block 40); and
- Inter-microphone level difference statistic imd is close to 0 dB (block 43).

Figure 7:
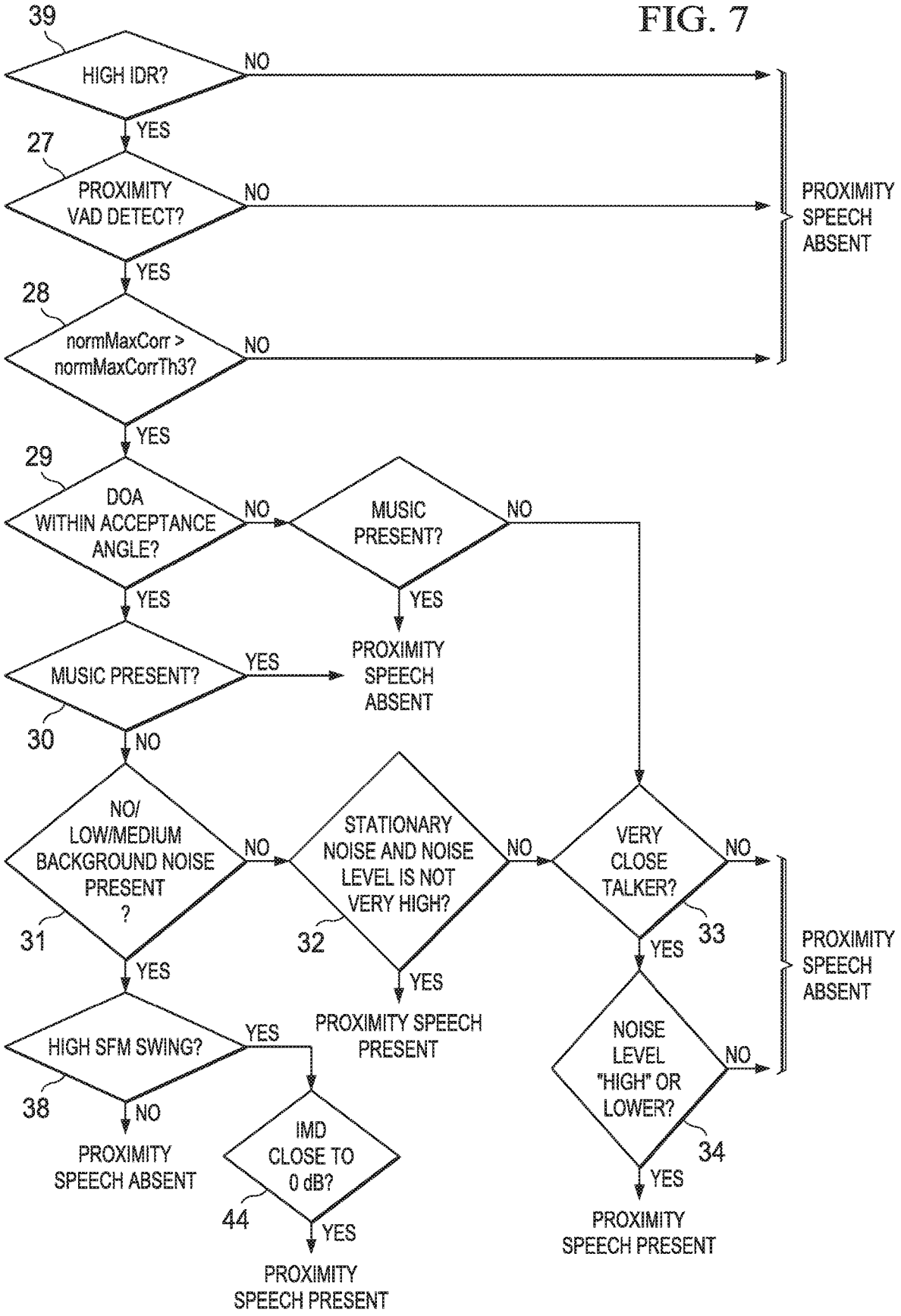
FIG. 7 illustrates an embodiment of a proximity speech detector, in accordance with embodiments of the present disclosure.

In some embodiments, the music detector taught in U.S. Pat. No. 8,126,706 may be used to implement music detector 9 to detect the presence of background music. Another embodiment of the proximity speech detector is shown in FIG. 7, in accordance with embodiments of the present disclosure. According to this embodiment, proximity speech may be detected if the following conditions are met:

- Interference to near-field desired signal ratio idr is greater than a threshold idrThres2 (block 39);
- Proximity voice activity is detected (block 27);
- Maximum normalized cross-correlation statistic normMaxCorr is greater than a threshold, normMaxCorrThres3 (block 28);
- Direction of arrival of estimate DOA is within an acceptance angle of proximity sound (block 29);
- Music is not detected in the background (block 30);
- Low or medium level background or no background noise is present (block 31).

This condition is verified by comparing the estimated background noise level with a threshold, noiseLevelThLo. If low noise level is detected, then the following two conditions are further tested to confirm the presence of proximity speech;

SFM variation statistic sfmSwing is greater than a threshold sfmSwingTh (block 38);

Inter-microphone level difference statistic imd is closer to 0 dB (block 44).

If the above-mentioned background noise level condition is not satisfied at block 31, then the following conditions may be indicative of proximity speech, in order to improve the detection rate of proximity speech without increasing occurrence of a false alarm (e.g., due to background noise conditions):

Stationary background noise is present (block 32). The stationary background noise may be detected by calculating the ratio of peak-to-root mean square value of the SFM generated by music detector (block 9) over a period of time. Specifically, if the above-mentioned ratio is higher, then non-stationary noise may be present as the spectral flatness measure of a non-stationary noise tends to change faster than stationary noises;

High noise level is present (block 32). The high noise-condition may be detected if the estimated background noise is greater than a threshold, noiseLevelLo and smaller than a threshold, noiseLevelHi.

If the above stationary noise and the direction of arrival conditions are not satisfied at block 32, then the presence of both of the following set of conditions may indicate the presence of proximity speech:

Close-talking proximity talker is present (block 33). A close-talking proximity talker may be detected when the maximum normalized cross-correlation statistic normMaxCorr is greater than a threshold, normMaxCorrThres4 (the threshold normMaxCorrThres4 may be greater than normMaxCorrThres3 to indicate the presence of close talker);

Low- or medium- or high-level background or no background noise is present (block 34). This condition may be detected if the estimated background noise level is less than a threshold noiseLevelThHi.

If the above-mentioned direction of arrival condition is not satisfied at block 29, then the presence of following conditions may be indicative of proximity speech:

The absence of music (block 35);

Close-talking proximity talker is present (block 33). A close-talking proximity talker may be detected when the maximum normalized cross-correlation statistic normMaxCorr is greater than a threshold, normMaxCorrThres4 (the threshold normMaxCorrThres4 may be greater than normMaxCorrThres3 to indicate the presence of close talker);

Low- or medium- or high-level background or no background noise is present (block 34). This condition may be detected if the estimated background noise level is less than a threshold noiseLevelThHi.

Tonal alarm detector 5 may be configured to detect alarm signals that are tonal in nature in which a sonic bandwidth of such alarm signals are also narrow (e.g., siren, buzzer). In some embodiments, the tonality of an ambient sound may be measured by splitting the time domain signal into multiple sub-bands through time to frequency domain transformation and the spectral flatness measure, depicted in FIG. 6 as signal sfm[ ] generated by music detector 9, may be computed in each sub-band. Spectral flatness measures sfm[ ] from all sub-bands may be evaluated, and a tonal alarm event may be detected if the spectrum is flat in most sub-bands but not in all sub-bands. Moreover, in a playback management system, it may not be necessary to detect far-field alarm signals. Accordingly, near-field spatial statistics 8 of FIG. 3 may be used to differentiate the far-field alarm signals from near-field signals. FIG. 8 illustrates example fusion logic for detecting a tonal alarm event (e.g. siren, buzzer), in accordance with embodiments of the present disclosure. As shown in FIG. 8, a tonal alarm event may be detected when all the following criteria are satisfied:

Direction of arrival estimate DOA is within an acceptance angle of the alarm signal (block 24);

Maximum normalized cross-correlation statistic normMaxCorr is greater than a threshold, normMaxCorrThres5 (block 25); and Spectral flatness measure sfm[ ] indicated that the noise spectrum is flat in most sub-bands but not all (block 26).

Figure 9:
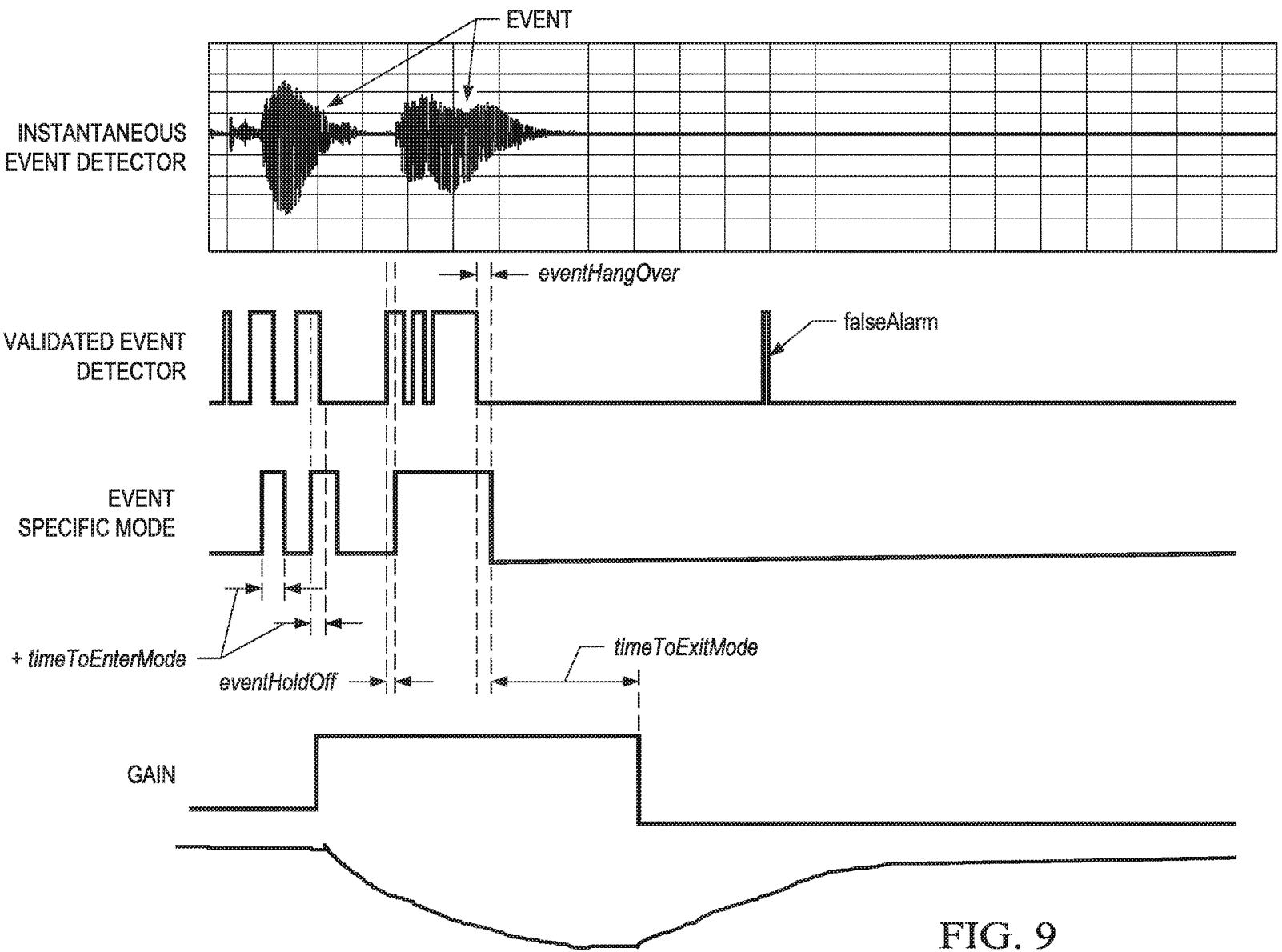
FIG. 9 illustrates an example timing diagram illustrating hold-off and hang-over logic that may be applied on an instantaneous audio event detection signal to generate a validated audio event signal, in accordance with embodiments of the present disclosure.

In practice, the instantaneous audio event detections of near-field detector 3, proximity detector 4, and tonal alarm detector 5 as shown in FIG. 5, FIG. 6, FIG. 7, and FIG. 8 may indicate false audio events. Accordingly, it may be desirable to validate an instantaneous audio event detection signal before communicating an event detection signal to playback control block 6. FIG. 9 illustrates an example timing diagram illustrating hold-off and hang-over logic that may be applied on an instantaneous audio event detection signal to generate a validated audio event signal, in accordance with embodiments of the present disclosure. As shown in FIG. 9, hold-off logic may generate a validated audio event signal in response to instantaneous detection of an audio event (e.g., near-field sound, proximity sound, tonal alarm event) being persistent for at least a predetermined time, while hang-over logic may continue to assert the validated audio event signal until the instantaneous detection of an audio event has ceased for a second predetermined time.

The following pseudo-code may demonstrate application of the hold-off and hang-over logic to reduce false detection of audio events, in accordance with embodiments of the present disclosure.

```
/* If the instant. detect is true, increment the hold off counter and
 * reset the hang over counter */
if(instDet == TRUE)
{
 holdOffCntr = holdOffCntr + 1;
 hangOverCntr = 0;
}
/* If the instant. detect is false, increment the hang over counter
 * and reset the hold off counter */
else
{
 hangOverCntr = hangOverCntr + 1;
 holdOffCntr = 0;
}
/*******************
 * Hold-off Logic *
 *******************/
/* Valid detect will transition to true state if the instant. detect is
 * continuously true for certian time and the previous valid
 detect is false */
if(holdOffCntr > holdOffThres && validDet == FALSE)
{
 validDet = TRUE;
 holdOffCntr = 0;
 hangOverCntr = 0;
}
/********************
 * Hang-Over Logic *
 ********************/
/* Valid NF detect will transition to false state if the instant.
 * NF detect is continuously false for certain time and the
```

-continued

```
    previous valid NF detect is true */
   if(hangOverCntr > hangOverThres && validDet == TRUE)
   {
     validDet = FALSE;
     holdOffCntr = 0;
     hangOverCntr = 0;
   }
```

A validated event may be further validated before generating the playback mode switching control. For example, the following pseudo-code may demonstrate application of the hold-off and hang-over logic for gracefully switching between a conversational mode (e.g., in which audio information reproduced to output audio transducer 51 may be modified in response to an audio event) and a normal playback mode (e.g., in which the audio information reproduced to output audio transducer 51 is unmodified).

```
/*********************************
 * Conversational Mode Enter Logic *
 *********************************/
/* Increment the time to enter conversational mode counter if the event
 * detect is true and the mode is not in the conversational mode. If the
 * counter exceeds the threshold, switch to conversational mode and
 * reset the counters. Note that the the event detect need not be true
 contiguously. */
if(convModeEn == FALSE && validDet == TRUE)
{
 timeToEnterConvModeCntr = timeToEnterConvModeCntr + 1;
 if(timeToEnterConvModeCntr > timeToEnterConvModeThres)
 {
  convModeEn = TRUE;
  timeToEnterConvModeCnt = 0;
  timeToExitConvModeCntr = 0;
 }
}
/*******************************
 * Conversational Mode Exit Logic *
 *******************************/
/* Increment the time to exit conversational mode counter if the event
 * detect is false and the mode is in the conversational mode. If the
 * counter exceeds the threshold, switch to normal mode and reset
 * the counters. Note that the the event detect must be false
 contiguously. */
if(convModeEn == TRUE && validDet == FALSE)
{
 timeToExitConvModeCntr++;
 if(timeToExitConvModeCntr > timeToExitConvModeThres)
 {
  convModeEn = FALSE;
  timeToEnterConvModeCntr = 0;
  timeToExitConvModeCntr = 0;
 }
}
else
{
  timeToExitConvModeCntr = 0;
}
```

FIG. 10 illustrates different audio event detectors having hold-off and hang-over logic, in accordance with embodiments of the present disclosure. The hold-off periods and/or hang-over periods for each detector may be set differently. In addition, in some embodiments, the playback management may be controlled differently based on the type of detected event. In these and other embodiments, as shown in FIG. 9, a playback gain (and hence the audio information reproduced at output audio transducer 51) may be attenuated whenever one or more of the audio events is detected. In these and other embodiments, in order to provide smooth gain transition, a playback gain may be smoothed using a first order exponential averaging filter represented by the following pseudo-code:

```
if(convModeEn == TRUE)
{
 playBackGain = (1-alpha)*convModeGain + alpha*playBackGain
}
else
{
 playBackGain = (1-beta)*normalModeGain + beta*playBackGain
}
```

The smoothing parameters alpha and beta may be set at different values to adjust a gain ramping rate.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure makes reference to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments likewise, with the benefit of this disclosure, will be apparent to those having ordinary skill in the art, and such embodiments should be deemed as being encompassed herein.

What is claimed is:

1. A method comprising:

receiving a first signal indicative of audio information;

based on the first signal, generating an audio output signal for communication to at least one transducer of an audio device;

causing the at least one transducer to generate sound in accordance with the audio output signal;

receiving at least one input signal indicative of ambient sound external to the audio device;

determining near-field spatial statistics for the ambient sound;

detecting, based on the at least one input signal, a near-field sound and a proximity sound in the ambient sound;

modifying a characteristic of the audio output signal in response to the detection of the near-field sound;

causing the at least one transducer to generate modified sound in accordance with the modified audio output signal;

determining a characteristic of the ambient sound, wherein determining the characteristic comprises determining that the ambient sound includes background music and/or determining that a background noise level in the ambient sound is above a threshold background noise level; and in response to the determined characteristic of the ambient sound, dynamically disabling the detection of the proximity sound to prevent false detection of proximity sounds.

2. The method of claim 1, further comprising determining from the at least one input signal a direction of the ambient sound and modifying the characteristic in response to the direction of the ambient sound indicating that the ambient sound is sound from a user of the audio device.

3. The method of claim 1, further comprising determining from the at least one input signal a direction of the ambient sound and modifying the characteristic in response to the direction of the ambient sound indicating that the ambient sound is speech from a user of the audio device.

4. The method of claim 1, wherein modifying the characteristic comprises attenuating the audio output signal.

5. The method of claim 1, further comprising modifying the characteristic in response to a detection of the near-field sound being persistent for at least a predetermined time.

6. The method of claim 5, further comprising:

detecting, from the at least one input signal, absence of the near-field sound in the ambient sound; and ceasing to modify the characteristic in response to the absence of the near-field sound for at least a second predetermined time.

7. The method of claim 1, further comprising:

in addition to detecting the near-field sound, detecting, from the at least one input signal, ambient sound other than the near-field sound in the ambient sound; and modifying the characteristic in response to detection of the ambient sound.

8. The method of claim 7, further comprising determining from the at least one input signal a direction of the ambient sound and modifying the characteristic in response to the direction of the ambient sound indicating that the ambient sound is sound other than the near-field sound.

9. The method of claim 7, further comprising:

detecting, from the at least one input signal, whether the ambient sound comprises background noise; and modifying the characteristic in response to detection of the background noise in the ambient sound.

10. The method of claim 7, further comprising:

detecting, from the at least one input signal, whether the ambient sound comprises a tonal alarm; and modifying the characteristic in response to detection of the tonal alarm in the ambient sound.

11. The method of claim 10, wherein detecting the tonal alarm in the ambient sound comprises:

detecting, from the at least one input signal, a direction of the ambient sound;

detecting, from the at least one input signal, a spectral flatness measure of the ambient sound; and detecting the tonal alarm based on the direction of the ambient sound, the presence or absence of background noise, and the near-field spatial statistics.

12. The method of claim 11, wherein:

the at least one input signal comprises a first microphone signal indicative of ambient sound at a first microphone and a second microphone signal indicative of ambient sound at a second microphone; and the near-field spatial statistics comprise a correlation between the first microphone signal and the second microphone signal.

13. The method of claim 11, wherein detecting the direction of the ambient sound comprises determining whether the direction of the ambient sound is within an acceptance angle of near-field sound.

14. The method of claim 11, wherein detecting the near-field spatial statistics comprises detecting whether a normalized cross-correlation statistic is greater than a threshold.

15. The method of claim 11, wherein detecting the spectral flatness measure of the ambient sound comprises detecting whether the noise spectrum is flat in most sub-bands of the ambient sound, but not all sub-bands of the ambient sound.

16. The method of claim 1, wherein detecting the near-field sound in the ambient sound comprises:

detecting, from the at least one input signal, a direction of the ambient sound;

detecting, from the at least one input signal, a presence of speech in the ambient sound; and detecting the near-field sound based on the direction, presence or absence of speech, and the near-field spatial statistics.

17. The method of claim 16, wherein:

the at least one input signal comprises a first microphone signal indicative of ambient sound at a first microphone and a second microphone signal indicative of ambient sound at a second microphone; and the near-field spatial statistics comprise a correlation between the first microphone signal and the second microphone signal.

18. The method of claim 16, wherein:

the at least one input signal comprises a first microphone signal indicative of ambient sound at a first microphone and a second microphone signal indicative of ambient sound at a second microphone; and the near-field spatial statistics comprise an interference-to-signal ratio associated with the near-field sound.

19. The method of claim 16, wherein:

the at least one input signal comprises a first microphone signal indicative of ambient sound at a first microphone and a second microphone signal indicative of ambient sound at a second microphone; and the near-field spatial statistics comprise an inter-microphone level difference between the first microphone signal and the second microphone signal.

20. The method of claim 16, wherein detecting the direction of the ambient sound comprises determining whether the direction of the ambient sound is within an acceptance angle of near-field sound.

21. The method of claim 16, wherein detecting the near-field spatial statistics comprises:

detecting whether a normalized cross-correlation statistic is greater than a first threshold;

detecting whether an interference to near-field desired signal ratio is lesser than a second threshold; and detecting whether an inter-microphone level difference is greater than a third threshold.

22. The method of claim 21, wherein the second threshold is adjusted based on an estimate of background noise in the ambient sound.

23. The method of claim 21, wherein the third threshold is adjusted based on an estimate of background noise in the ambient sound.

24. The method of claim 1, further comprising:

detecting, from the at least one input signal, a direction of the ambient sound;

detecting, from the at least one input signal, a presence of background noise in the ambient sound;

detecting, from the at least one input signal, a presence of proximity speech in the ambient sound;

detecting, from the at least one input signal, a volume of the ambient sound;

detecting, based on the direction, presence or absence of background noise, presence or absence of the speech, the volume, and the near-field spatial statistics, a presence of an audio event comprising a proximity sound event; and modifying the characteristic in response to detection of the presence of the audio event.

25. The method of claim 24, further comprising:

detecting variation in spectral content of the ambient sound; and detecting, based on the direction, presence or absence of background noise, presence or absence of the speech, the volume, the near-field spatial statistics, and the spectral content of the ambient sound, a presence of an audio event comprising a proximity sound event.

26. The method of claim 25, wherein:

the at least one input signal comprises a first microphone signal indicative of ambient sound at a first microphone and a second microphone signal indicative of ambient sound at a second microphone; and the near-field spatial statistics comprise a correlation between the first microphone signal and the second microphone signal.

27. The method of claim 25, wherein:

the at least one input signal comprises a first microphone signal indicative of ambient sound at a first microphone and a second microphone signal indicative of ambient sound at a second microphone; and the near-field spatial statistics comprise an interference-to-signal ratio associated with the near-field sound.

28. The method of claim 25, wherein:

the at least one input signal comprises a first microphone signal indicative of ambient sound at a first microphone and a second microphone signal indicative of ambient sound at a second microphone; and the near-field spatial statistics comprise an inter-microphone level difference between the first microphone signal and the second microphone signal.

29. The method of claim 25, wherein detecting the presence of proximity speech in the ambient sound comprises detecting stationary background noise.

30. The method of claim 25, wherein detecting the presence of proximity speech in the ambient sound comprises detecting speech from a close-talking proximity talker.

31. The method of claim 25, wherein detecting the presence of proximity speech in the ambient sound comprises detecting, from the at least one input signal, a spectral flatness measure of the ambient sound, wherein detecting the spectral flatness measure of the ambient sound comprises detecting variation in spectral content of the ambient sound.

32. An integrated circuit for implementing at least a portion of an audio device, comprising:

an input configured to receive a first signal indicative of audio information;

an audio output configured to, based on the first signal, generate an audio output signal for communication to at least one transducer of the audio device, the audio output being operable to cause the at least one transducer to generate sound in accordance with the audio output signal;

a microphone input configured to receive at least one input signal indicative of ambient sound external to the audio device; and a processor configured to:

determine near-field spatial statistics for the ambient sound;

detect, based on the at least one input signal, a near-field sound and a proximity sound in the ambient sound;

modify a characteristic of the audio output signal in response to the detection of the near-field sound; and cause the at least one transducer to generate modified sound in accordance with the modified audio output signal;

determine a characteristic of the ambient sound, wherein determining the characteristic comprises determining that the ambient sound includes background music and/or determining that a background noise level in the ambient sound is above a threshold background noise level; and in response to the determined characteristic of the ambient sound, dynamically disable the detection of the proximity sound to prevent false detection of proximity sounds.

33. The integrated circuit of claim 32, the processor further configured to:

determine, from the at least one input signal, a direction of the ambient sound; and modify the characteristic in response to the direction of the ambient sound indicating that the ambient sound is sound from a user of the audio device.

34. The integrated circuit of claim 32, the processor further configured to:

determine, from the at least one input signal, a direction of the ambient sound; and modify the characteristic in response to the direction of the ambient sound indicating that the ambient sound is speech from a user of the audio device.

35. The integrated circuit of claim 32, wherein modifying the characteristic comprises attenuating the audio output signal.

36. The integrated circuit of claim 32, the processor further configured to modify the characteristic in response to a detection of the near-field sound being persistent for at least a predetermined time.

37. The integrated circuit of claim 36, the processor further configured to:

detect, from the at least one input signal, absence of the near-field sound in the ambient sound; and cease modifying the characteristic in response to the absence of the near-field sound for at least a second predetermined time.

38. The integrated circuit of claim 36, the processor further configured to:

in addition to detecting the near-field sound, detect, from the at least one input signal, ambient sound other than the near-field sound in the ambient sound; and modify the characteristic in response to detection of the ambient sound.

39. The integrated circuit of claim 38, the processor further configured to:

determine, from the at least one input signal, a direction of the ambient sound; and modify the characteristic in response to the direction of the ambient sound indicating that the ambient sound is sound other than the near-field sound.

40. The integrated circuit of claim 38, the processor further configured to:

detect, from the at least one input signal, whether the ambient sound comprises background noise; and modify the characteristic in response to detection of the background noise in the ambient sound.

41. The integrated circuit of claim 38, the processor further configured to:

detect, from the at least one input signal, whether the ambient sound comprises a tonal alarm; and modify the characteristic in response to detection of the tonal alarm in the ambient sound.

42. The integrated circuit of claim 41, wherein detecting the tonal alarm in the ambient sound comprises:

detecting, from the at least one input signal, a direction of the ambient sound;

detecting, from the at least one input signal, a spectral flatness measure of the ambient sound; and detecting the tonal alarm based on the direction of the ambient sound, the presence or absence of background noise, and the near-field spatial statistics.

43. The integrated circuit of claim 41, wherein:

the at least one input signal comprises a first microphone signal indicative of ambient sound at a first microphone and a second microphone signal indicative of ambient sound at a second microphone; and the near-field spatial statistics comprise a correlation between the first microphone signal and the second microphone signal.

44. The integrated circuit of claim 42, wherein detecting the direction of the ambient sound comprises determining whether the direction of the ambient sound is within an acceptance angle of near-field sound.

45. The integrated circuit of claim 42, wherein detecting the near- field spatial statistics comprises detecting whether a normalized cross-correlation statistic is greater than a threshold.

46. The integrated circuit of claim 42, wherein detecting the spectral flatness measure of the ambient sound comprises detecting whether the noise spectrum is flat in most sub-bands of the ambient sound, but not all sub-bands of the ambient sound.

47. The integrated circuit of claim 32, wherein detecting the near- field sound in the ambient sound comprises:

detecting, from the at least one input signal, a direction of the ambient sound;

detecting, from the at least one input signal, a presence of speech in the ambient sound; and detecting the near-field sound based on the direction, presence or absence of the speech, and the near-field spatial statistics.

48. The integrated circuit of claim 47, wherein:

the at least one input signal comprises a first microphone signal indicative of ambient sound at a first microphone and a second microphone signal indicative of ambient sound at a second microphone; and the near-field spatial statistics comprise a correlation between the first microphone signal and the second microphone signal.

49. The integrated circuit of claim 47, wherein:

the at least one input signal comprises a first microphone signal indicative of ambient sound at a first microphone and a second microphone signal indicative of ambient sound at a second microphone; and the near-field spatial statistics comprise an interference-to-signal ratio associated with near-field sound.

50. The integrated circuit of claim 47, wherein:

the at least one input signal comprises a first microphone signal indicative of ambient sound at a first microphone and a second microphone signal indicative of ambient sound at a second microphone; and the near-field spatial statistics comprise an inter-microphone level difference between the first microphone signal and the second microphone signal.

51. The integrated circuit of claim 47, wherein detecting the direction of the ambient sound comprises determining whether the direction of the ambient sound is within an acceptance angle of near-field sound.

52. The integrated circuit of claim 47, wherein detecting the near- field spatial statistics comprises:

detecting whether a normalized cross-correlation statistic is greater than a first threshold;

detecting whether an interference to near-field desired signal ratio is lesser than a second threshold; and detecting whether an inter-microphone level difference is greater than a third threshold.

53. The integrated circuit of claim 52, wherein the second threshold is adjustable based on an estimate of background noise in the ambient sound.

54. The integrated circuit of claim 52, wherein the second threshold is adjustable based on an estimate of background noise in the ambient sound.

55. The integrated circuit of claim 32, the processor further configured to:

detect, from the at least one input signal, a direction of the ambient sound;

detect, from the at least one input signal, a presence of background noise in the ambient sound;

detect, from the at least one input signal, a presence of proximity speech in the ambient sound;

detect, from the at least one input signal, a volume of the ambient sound;

detect, based on the direction, presence or absence of background noise, presence or absence of the speech, the volume, and the near-field spatial statistics, a presence of an audio event comprising a proximity sound event; and modify the characteristic in response to detection of the presence of the audio event.

56. The integrated circuit of claim 55, the processor further configured to:

detect variation in spectral content of the ambient sound; and detect, based on the direction, presence or absence of background noise, presence or absence of the speech, the volume, the near-field spatial statistics, and the spectral content of the ambient sound, a presence of an audio event comprising a proximity sound event.

57. The integrated circuit of claim 56, wherein:

the at least one input signal comprises a first microphone signal indicative of ambient sound at a first microphone and a second microphone signal indicative of ambient sound at a second microphone; and the near-field spatial statistics comprise a correlation between the first microphone signal and the second microphone signal.

58. The integrated circuit of claim 56, wherein:

the at least one input signal comprises a first microphone signal indicative of ambient sound at a first microphone and a second microphone signal indicative of ambient sound at a second microphone; and the near-field spatial statistics comprise an interference-to-signal ratio associated with near-field sound.

59. The integrated circuit of claim 56, wherein:

the at least one input signal comprises a first microphone signal indicative of ambient sound at a first microphone and a second microphone signal indicative of ambient sound at a second microphone; and the near-field spatial statistics comprise an inter-microphone level difference between the first microphone signal and the second microphone signal.

60. The integrated circuit of claim 56, wherein detecting the presence of proximity speech in the ambient sound comprises detecting stationary background noise.

61. The integrated circuit of claim 56, wherein detecting the presence of proximity speech in the ambient sound comprises detecting speech from a close-talking proximity talker.

62. The integrated circuit of claim 56, wherein detecting the presence of proximity speech in the ambient sound comprises detecting, from the at least one input signal, a spectral flatness measure of the ambient sound, wherein detecting the spectral flatness measure of the ambient sound comprises detecting variation in spectral content of the ambient sound.

63. A method comprising:

receiving a first signal indicative of audio information;

based on the first signal, generating an audio output signal for communication to at least one transducer of an audio device;

causing the at least one transducer to generate sound in accordance with the audio output signal;

receiving at least one input signal indicative of ambient sound external to the audio device;

determining near-field spatial statistics for the ambient sound;

detecting, based on the at least one input signal, an audio event comprising a proximity sound;

modifying a characteristic of the audio output signal in response to the detection of the audio event being persistent for at least a predetermined time;

causing the at least one transducer to generate modified sound in accordance with the modified audio output signal;

determining a characteristic of the ambient sound, wherein determining the characteristic comprises determining that the ambient sound includes background music and/or determining that a background noise level in the ambient sound is above a threshold background noise level; and in response to the determined characteristic of the ambient sound, dynamically disabling the detection of the proximity sound to prevent false detection of proximity sounds.

64. The method of claim 63, further comprising ceasing to modify the characteristic of the audio information in response to an absence of the audio event for at least a second predetermined time.

65. The method of claim 63, wherein the audio event comprises at least one of a near-field event, a proximity event, and an alarm event.

66. An integrated circuit for implementing at least a portion of an audio device, comprising:

an input configured to receive a first signal indicative of audio information;

an audio output configured to, based on the first signal, generate an audio output signal for communication to at least one transducer of the audio device, the audio output being operable to cause the at least one transducer to generate sound in accordance with the audio output signal;

a microphone input configured to receive at least one input signal indicative of ambient sound external to the audio device; and a processor configured to:

determine near-field spatial statistics for the ambient sound;

detect, based on the input signal, an audio event comprising a proximity sound;

modify a characteristic of the audio output signal in response to the detection of the audio event being persistent for at least a predetermined time;

cause the at least one transducer to generate modified sound in accordance with the modified audio output signal;

determine a characteristic of the ambient sound, wherein determining the characteristic comprises determining that the ambient sound includes background music and/or determining that a background noise level in the ambient sound is above a threshold background noise level; and in response to the determined characteristic of the ambient sound, dynamically disable the detection of the proximity sound to prevent false detection of proximity sounds.

67. The integrated circuit of claim 66, the processor further configured to cease modifying the characteristic in response to an absence of the audio event for at least a second predetermined time.

68. The integrated circuit of claim 66, wherein the audio event comprises at least one of a near-field event, a proximity event, and an alarm event.

69. The method of claim 1, further comprising:

determining a background noise level of a background noise component of the ambient sound;

determining spectral characteristics of the background noise component; and based on the background noise level and the spectral characteristics, determining that the ambient sound includes a component corresponding to speech of a person in proximity to the audio device.

70. The method of claim 69, wherein the modifying the characteristic of the audio output signal is based on the background noise level in conjunction with the spectral characteristics of the background noise component.

71. The method of claim 69, wherein the spectral characteristics are indicative of stationary background noise.

72. The method of claim 1, wherein determining the characteristic of the ambient sound comprises determining that the ambient sound includes background music.

73. The method of claim 1, wherein determining the characteristic of the ambient sound comprises determining that a background noise level in the ambient sound is above a threshold background noise level.

* * * * *